US006662729B1

(12) United States Patent
Madison

(10) Patent No.: US 6,662,729 B1
(45) Date of Patent: Dec. 16, 2003

(54) RAIL ANCHOR SPREADER

(75) Inventor: Harry Madison, Memphis, TN (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 10/208,067

(22) Filed: Jul. 30, 2002

(51) Int. Cl.[7] ..... E01B 29/00
(52) U.S. Cl. ..... 104/17.2
(58) Field of Search ..... 104/7.2, 2, 307, 104/12, 7.1, 17.2, 8, 16, 17.1

(56) References Cited

U.S. PATENT DOCUMENTS

| | | | | | |
|---|---|---|---|---|---|
| 3,119,346 | A | * | 1/1964 | Derler | 104/12 |
| 3,299,833 | A | * | 1/1967 | Stewart | 104/7.1 |
| 4,068,593 | A | * | 1/1978 | Leeves | 104/307 |
| 4,308,937 | A | * | 1/1982 | Johnson | 188/43 |
| 4,319,392 | A | * | 3/1982 | Cutts | 29/402.08 |
| 4,580,501 | A | * | 4/1986 | Collins et al. | 104/307 |
| 4,744,302 | A | * | 5/1988 | Theurer et al. | 104/7.2 |
| 4,890,558 | A | | 1/1990 | Quella et al. | |
| 4,903,611 | A | | 2/1990 | Holley | |
| 5,074,219 | A | | 12/1991 | Theurer et al. | |
| 5,117,760 | A | | 6/1992 | Almaraz et al. | |
| 5,277,122 | A | | 1/1994 | Almaraz et al. | |
| 5,438,931 | A | | 8/1995 | Becker et al. | |
| 5,546,864 | A | | 8/1996 | Straub et al. | |
| 5,586,502 | A | * | 12/1996 | Weber | 104/17.2 |
| 5,694,856 | A | * | 12/1997 | Theurer | 104/17.2 |
| 5,730,060 | A | | 3/1998 | Straub et al. | |
| 5,915,744 | A | | 6/1999 | Cotsford | |
| 6,138,573 | A | * | 10/2000 | Brenny et al. | 104/17.2 |

* cited by examiner

*Primary Examiner*—Mark T. Le
(74) *Attorney, Agent, or Firm*—William E. Lang, IV; Eckert Seamans Cherin & Mellott, LLC

(57) ABSTRACT

A railway anchor spreader has a rotating plate on each side of each rail, with the bottom of each rotating plate having a pair of jaws. The tie plates are lowered until the jaws strike the ballast, and the tie plates are then pivoted first in one direction, and then in the opposite direction, by a hydraulic cylinder located near the top of the anchor spreader plates. The jaws will thereby strike the tie plates, first pushing them in one direction and then in the opposite direction, to move the rail anchors away from the tie. The shape of the jaws ensures that pivoting the anchor spreader plate will not cause the jaws to strike the tie as well as the tie plate. A rail clamp capable of grabbing rails of various sizes is also provided.

17 Claims, 6 Drawing Sheets

RAIL ANCHOR SPREADER

BACKGROUND OF THE INVENTION

1. Field of the Invention

The present invention relates to railway maintenance. More specifically, the present invention provides an improved rail anchor spreader.

2. Description of the Related Art

The rails of a railroad track are usually secured to cross ties by spikes driven into tie plates, with the tie plates located between the rail and the tie, and the head of the spike overlapping the bottom of the rail. The tie plates block lateral movement of the rails, and anchors attached to the rail on either side of the tie are used to secure the rail against longitudinal movement.

Railroad ties occasionally must be replaced due to wear. When a tie must be replaced, the spikes are first removed. Next, the anchors are spread away from the time to provide space for removal of the old tie and insertion of the new tie.

Several other patents propose various methods of removing and/or spreading rail anchors. One example is U.S. Pat. No. 4,890,558, issued to D. C. Quella et al. on Jan. 2, 1990. This patent describes an anchor spreader having a head assembly with a pair of telescoping spreader plates, controlled by hydraulic cylinders, for pushing the anchors away from the ties. The head assembly includes stop members to control the height of the head during an anchor-spreading operation. A rail clamp prevents longitudinal movement of the head during an anchor-spreading operation.

U.S. Pat. No. 4,903,611, issued to J. D. Holley on Feb. 27, 1990, describes an anchor-spreading mechanism having an anchor-spreading head, and a rail clamp. The vertical position of the head is controlled by a hydraulic cylinder. After lowering the head and clamping the rail, horizontal hydraulic cylinders located adjacent to the pusher, and in close proximity to the ballast, cause a pusher to be moved back and forth, pushing the tie plate off the tie in one direction, and then the other direction, thereby moving the anchors away from the tie.

U.S. Pat. No. 5,074,219, issued to J. Theurer et al. on Dec. 24, 1991, describes a rail anchor removing vehicle having the carrier arms for the anchor remover heads directly below the cab. The cab of the vehicle has a transparent floor. The carrier frame rests on a flanged wheel that rolls along the rail during the anchor removal operation. Each anchor remover head includes a hammer for driving the field side of the anchor downward, and a stripping element for pulling the anchor out from under the track, towards the gauge side. The hammer may include a horizontal portion for driving the anchor downward, and a vertical portion for driving the anchor toward the gauge side of the rail. A magnetic anchor collecting drive retrieves the anchors and transfers them to a conveyor, which transports them to a storage container.

U.S. Pat. No. 5,117,760, issued to R. Almarez et al. on Jun. 2, 1992, describes a rail anchor spreader having a pair of spreader bars with interchangeable spreader plates at their tips for engaging different rail anchors. A limit switch controls the vertical positioning of the spreader assembly. Each spreader bar is pulled outward by a hydraulic cylinder to move its anchor, with its limit of travel set by placing a threaded bolt at the maximum outward travel position.

U.S. Pat. No. 5,277,122, issued to R. Almaraz et al. on Jun. 11, 1994, describes a rail anchor adjuster for moving railway anchors towards the tie. The anchor adjuster includes a pair of pivoting arms having top ends connected by a hydraulic cylinder, and bottom ends dimensioned and configured to engage the rail anchors. The height of the anchor adjuster assembly is controlled by interchangeable stop pads.

U.S. Pat. No. 5,438,931, issued to N. W. Becker et al. on Aug. 8, 1995, describes a rail anchor remover having a telescoping ram assembly for driving the tail of the anchor below the base of the rail, a kicker assembly for driving the anchor transversely under the rail towards the gauge side of the rail, and a window assembly for driving the anchor away from the rail.

U.S. Pat. No. 5,546,864, issued to W. Straub et al. on Aug. 20, 1996, describes a rail anchor remover having a reciprocating pusher for pushing the anchor downward away from the rail, and a reciprocating scraper for pulling the anchor out from under the rail. Proximity switches are used to monitor the position of the pusher and scraper. A similar device is described in U.S. Pat. No. 5,730,060, also issued to W. Straub et al., on Mar. 24, 1998.

U.S. Pat. No. 5,915,744, issued to S. G. Cotsford on Jun. 29, 1999, and assigned to Harsco Corporation, the assignee of the present invention, describes a rail anchor removal machine and method using anchor removing rollers, and a conveyor system for moving the removed anchors to the side of the railroad track. The anchors are removed by angled rollers as the rail is raised, which push the anchors downward and towards the gauge side of the track as they roll over the anchor. A funnel-like anchor catch deflects the removed anchors towards a conveyor, which deposits them alongside the track.

Many of the above-described patents propose devices requiring that the height of the anchor spreader be adjusted and set each time it is used with a different height rail. Furthermore, the means for properly positioning the anchor spreader must, in addition to properly positioning the spreader, ensure that movement of the spreader to spread the anchors does not pose a risk of striking the ties. Accordingly, there is a need for an anchor spreader capable of being used with multiple heights of rail without adjustments. Additionally, there is a need for a height adjustment means that positions the anchor spreader where it will not strike other components of the railway. Further, some of the above-described references position hydraulic cylinders relatively close to the ballast surrounding the ties, resulting in the potential for interference between this ballast and the hydraulic cylinders. Accordingly, there is a need for a railway anchor spreader having hydraulic cylinders and other components kept away from the ballast.

SUMMARY OF THE INVENTION

The present invention provides a railway anchor spreader vehicle capable of being used with any size rail, without adjustment, and without any danger of striking the wrong portions of the railway during operation. Additionally, the present invention provides a railway anchor spreader wherein critical components are kept away from locations wherein they may experience interference from the ballast. Furthermore, the present invention provides a rail clamp dimensioned and configured to grasp the lower corners of the rails' ball, thereby permitting the clamp to properly grasp a wide variety of rails.

A rail anchor spreader of the present invention includes four plates, pivotally secured to an anchor spreader vehicle so that the anchor spreader plates pivot in unison. Each plate corresponds to one side of one rail. The means for rotating the plates, for example, a hydraulic cylinder, is preferably located at or near the top of the plates. The bottom of each plate includes a pair of jaws. Each jaw includes a first surface facing its opposing jaw, with the first surface being substantially vertical, and a second surface including the bottom and side facing away from the opposing jaw, with the second surface being a convex curve.

The entire anchor spreader assembly is preferably mounted to a railway vehicle, and is more preferably mounted to the front of the railway vehicle. One preferred means of mounting the anchor spreader assembly to a railway vehicle uses a raise/lower cylinder secured between the vehicle and a pivotally secured raised/lower lever arm. The other end of the raise/lower lever arm may be secured to the anchor spreader assembly. Extending the raise/lower cylinder will therefore pivot the rail anchor spreader assembly upward, while retracting the raise/lower cylinder will lower the anchor spreader assembly.

The railway vehicle also includes a rail clamp for grasping the rail, thereby preventing longitudinal movement of the vehicle during an anchor spreading operation. The rail clamp is dimensioned and configured to grab the rails' ball from its lower corners, thereby permitting the upward angled surfaces of the rail clamp's jaws to accommodate a wide variety of rail sizes. Some preferred embodiments of the rail clamp may accommodate rails ranging from 60 lb./yd. to 150 lb./yd.

In use, the railway vehicle is positioned so that the anchor spreader is over the tie to be replaced. The rail clamp engages the rail, holding the vehicle in position. The anchor spreader is lowered until the jaws strike the ballast. The anchor spreader plates are then rotated in a first direction, and then in a second direction, so that the jaws first push the tie plates in a first direction to move one of the two anchors away from the tie, and then push the tie plate a second direction to push the second of the two anchors away from the tie. The shape of the jaws ensures that, when the anchor spreader is lowered until the jaws strike the ballast, rotation of the anchor spreader will cause the jaws to strike the tie plate without striking the tie.

BRIEF DESCRIPTION OF THE DRAWINGS

Like reference numbers denote like elements throughout the drawings.

DETAILED DESCRIPTION

Figure 1:
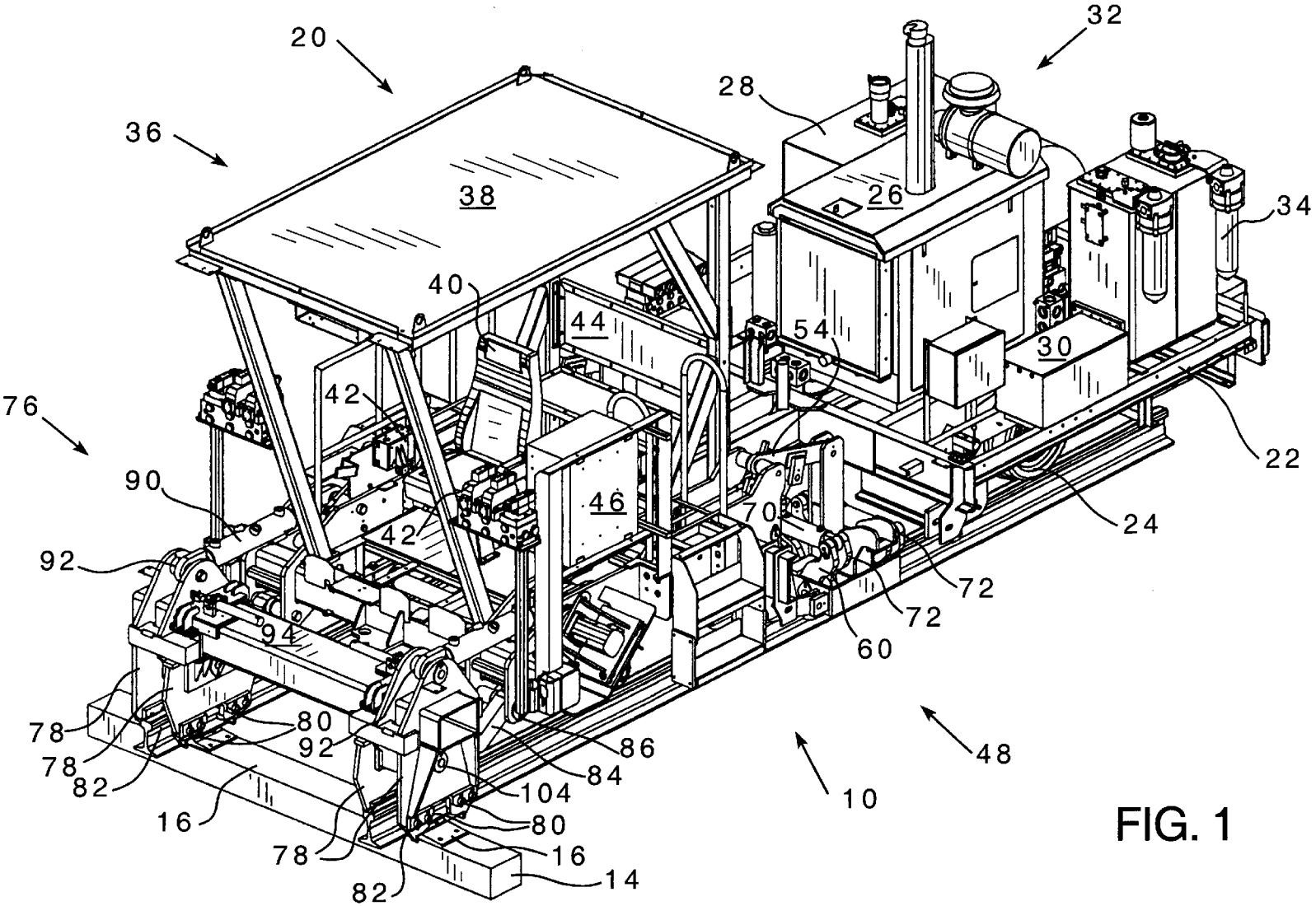
FIG. 1 is an isometric front view of a railway anchor spreader vehicle according to the present invention.

The present invention is an apparatus and method for spreading the anchors securing a rail 12 in place longitudinally with respect to its tie 14, prior to replacement of the tie 14.

A typical railway 10 includes a pair of rails 12 supported by ties 14. The ties 14 are typically embedded in ballast to prevent their movement. A tie plate 16 fits between the rail 12 and the tie 14, with a plurality of spikes passing through the tie 14 and tie plate 16, and having their heads overlap the bottom flange of the rail 12. The spikes and tie plate 16 thereby secure the rail 12 against transverse movement with respect to the tie 14. A rail anchor 18 fits on either side of the tie 14, and is generally secured to the gauge size of the rail 12. The rail anchor 18 prevents longitudinal movement of the rail 12 with the respect to the tie 14.

During a tie 14 replacement operation, it is necessary to spread the anchors 18 apart from the tie 14, thereby making room for a new tie 14 to pass between the anchors 18. The present invention is directed towards this end.

Figure 2:
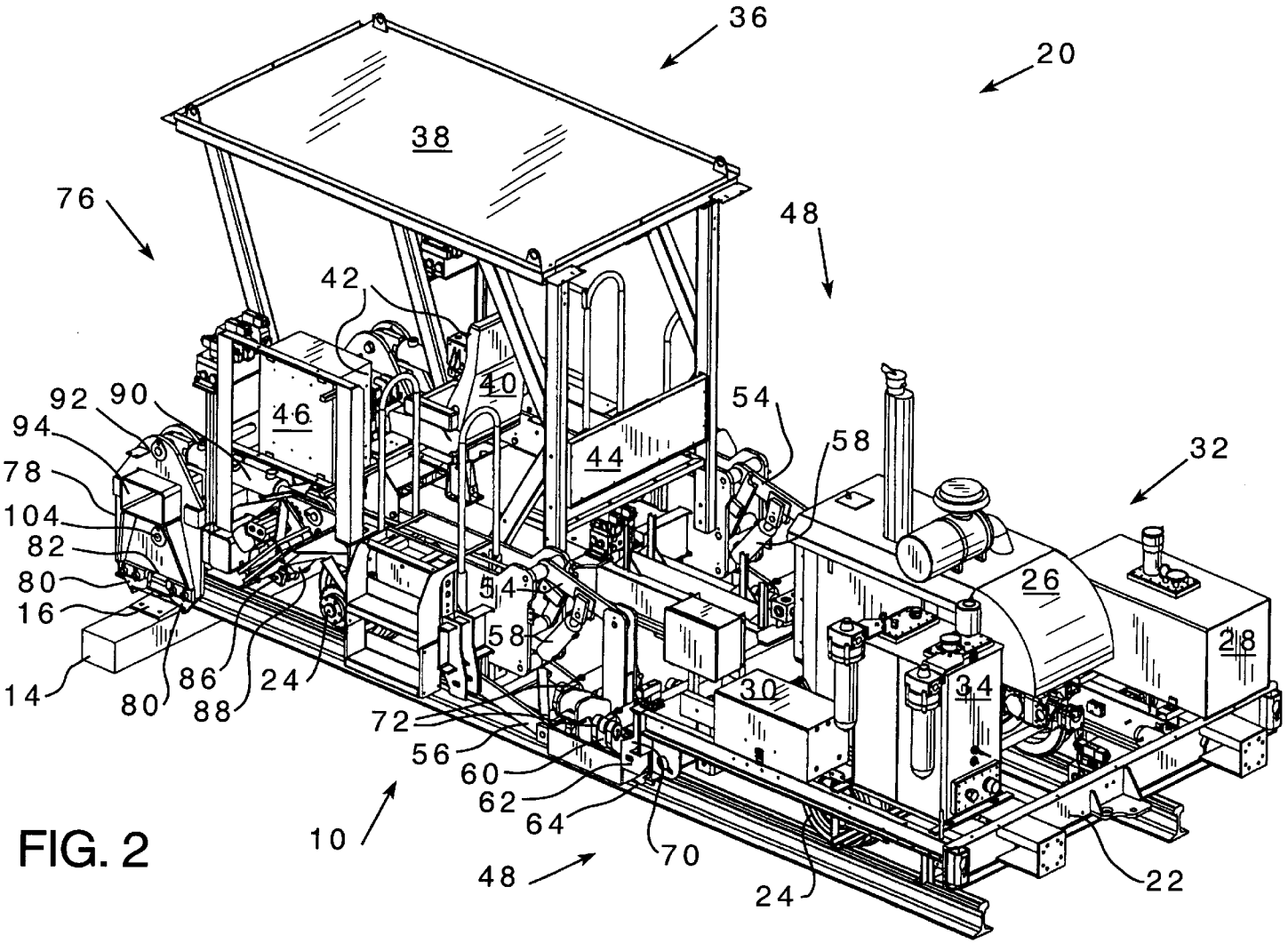
FIG. 2 is an isometric rear view of a railway anchor spreader vehicle according to the present invention.
Figure 3:
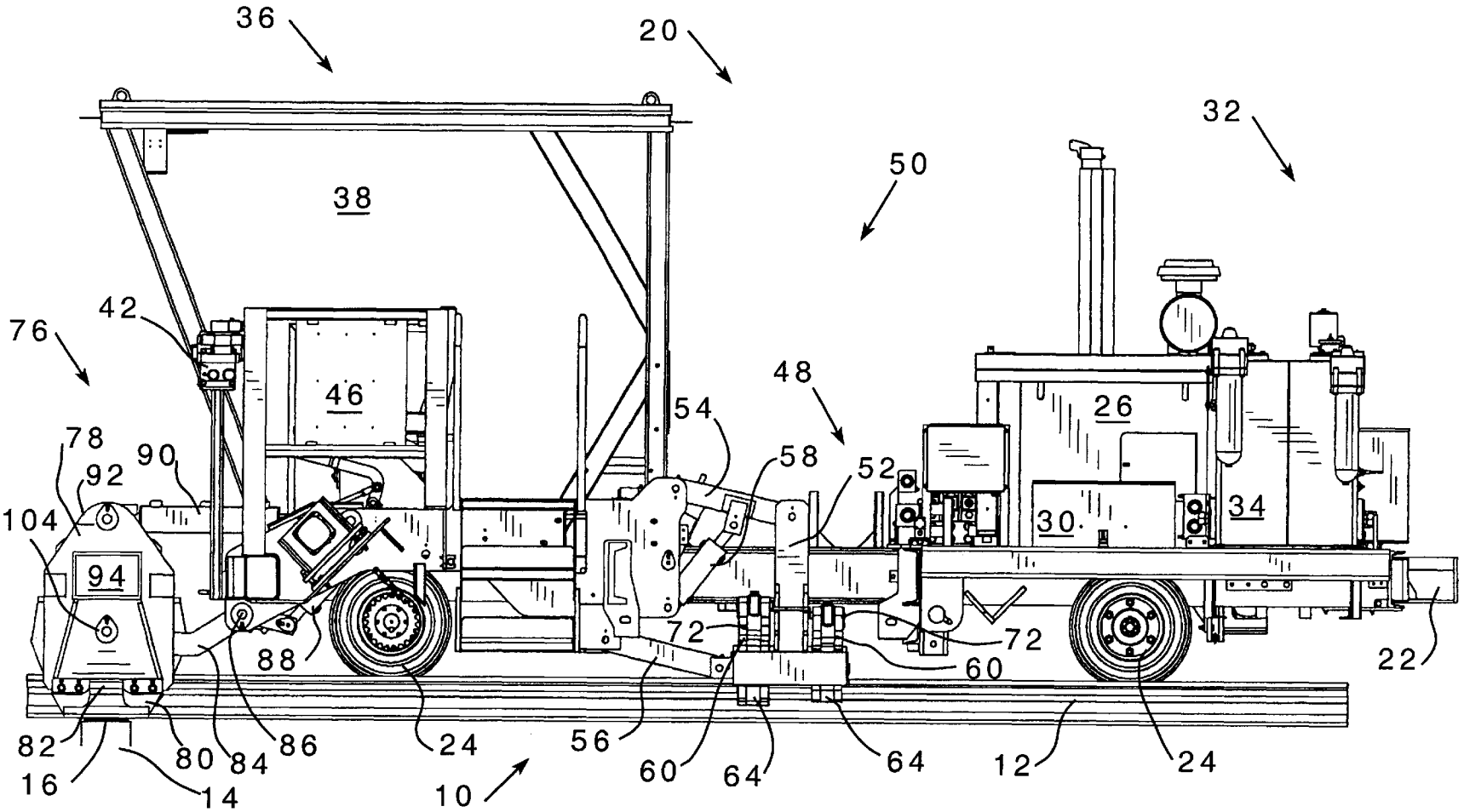
FIG. 3 is a side view of a railway anchor spreader vehicle according to the present invention.
Figure 5:
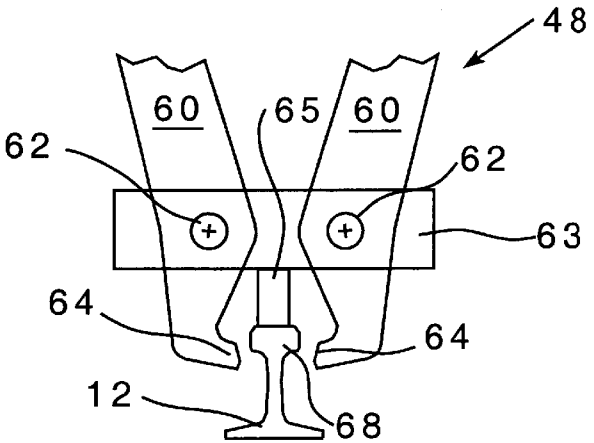
FIG. 5 is a front view of a rail clamp for use with a railway anchor vehicle of the present invention, illustrating the clamp in its unclamped position around a first size rail.
Figure 7:
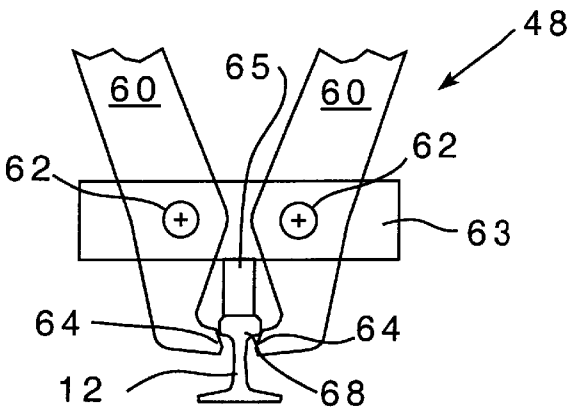
FIG. 7 is a front view of a rail clamp for use with a railway anchor spreader vehicle according to the present invention, showing the clamp grasping the ball of a second size rail.
Figure 4:
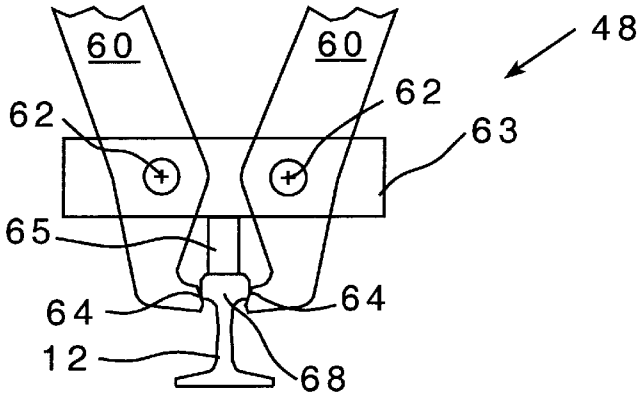
FIG. 4 is a front view of a rail clamp for use with a railway anchor spreader vehicle of the present invention illustrating the clamp being used with a first size rail.

Referring to FIGS. 1–3, a rail anchor spreader vehicle 20 is illustrated. The vehicle 20 includes a chassis 22 having a plurality of wheels 24 for engaging the rails 12. The vehicle 20 is powered by a motor 26, located at the rear of the chassis 22, where a fuel storage tank 28 and batter 30 are also located. The rear portion 32 of the chassis 22 also includes a storage tank 34 for the hydraulic fluid that, in some preferred embodiments, supplies mechanical power to other components of the vehicle 20.

The front portion 36 of the vehicle 20 includes an operator's cab 38, including an operator's chair 40 and controls 42. Some preferred embodiments of the operator's cab 38 may include a passenger bench 44. The vehicle's electronic control system 46 may, if desired, also be located in the front portion 36.

The vehicle 20 includes a rail clamp 48 for preventing longitudinal movement of the vehicle during the anchor spreading operation. Some preferred embodiments may locate the rail clamp 48 in the center portion 50 of the vehicle 20. The rail clamp 48 is mounted on a carriage 52, secured to the chassis 22 in a manner permitting the carriage 52 to be raised and lowered as desired. In some preferred embodiments, the carriage 52 includes at least one arm 54 and at least one arm 56, pivotally secured at one end to the carriage 52, and at the other end to the chassis 22. The illustrated example includes one arm 54 and two arms 56. A clamp raise/lower cylinder 58 is pivotally secured at one end to the chassis 22, and at the other end to the arm 54, so that expanding the hydraulic cylinder 58 will raise the clamp, and retracting the hydraulic cylinder 58 will lower the clamp.

Referring to FIGS. 1, 2, and 4–7, the clamp 48 includes at least one pair of arms 60 for grasping a rail 12. The illustrated embodiment includes two pairs of arms 60. The arms 60 are pivotally mounted on a cross beam 63 at pivot 62, which in some preferred embodiments will be relatively close to the grasping tips 64, which are dimensioned and configured to engage the lower corners 66 of the rail's ball 68. In the illustrated example, the tips 64 have the form of an angled, upward facing surface. A clamping hydraulic cylinder 70 extends between the top portions 72, being pivotally secured to each top portion 72. In many preferred embodiments, the distance between the pivot 62 and the arm grasping tips 64 is significantly less than the distance between the pivot 62 and the top portion 72 of the arm 60. The arm 60 will therefore act as force multipliers, so that the force with which the grasping tips 64 engage the ball 68 will be significantly greater than the force applied by the hydraulic cylinder 70.

Figure 6:
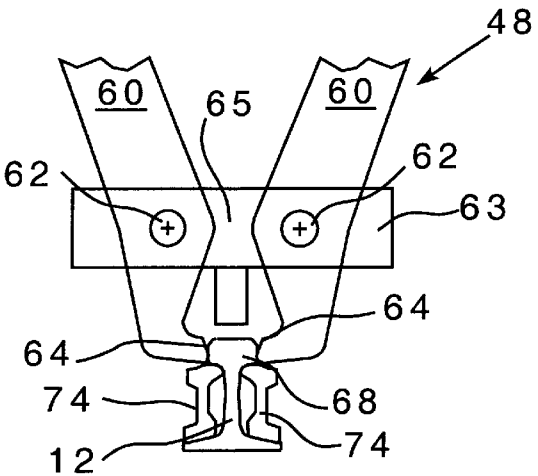
FIG. 6 is a front view of a railway clamp for use with a railway anchor spreader vehicle according to the present invention, illustrating the rail clamp grasping the head of a first size rail, above a pair of joint bars.

Referring to FIGS. 4–7, these figures illustrate how a rail clamp as herein described may engage rails of various sizes without modification or adjustments to the rail clamp 48 itself. A stop member 65 extends downward from the cross member 63. The stop 65 is dimensioned and configured so that, when the rail clamp 48 is lowered until the stop 65 touches the ball 68 of the rail 12, the grasping tips 64 will be positioned to engage the lower surfaces of the ball 68. As FIGS. 4–7 illustrate, the grasping tips 64 may contact the ball 68 at any portion along the upward angled surfaces of 64. Therefore, a larger rail will be engaged closer to the bottom portions of the grasping tips 64, while a smaller rail will be grasped toward the top portions of the grasping tips 64. Therefore, the rail clamp may be utilized with a wide variety of rail sizes without modification adjustment, and many preferred embodiments may be utilized with rail sizes ranging from approximately 60 lbs./yd. to approximately 150 lbs./yd. Additionally, as illustrated in FIG. 6, the rail clamp 48 may grasp the ball 68 of a rail 12 at a point wherein two adjacent rail sections are joined by joint bar 74, without interference from the joint bars 74.

Referring to FIGS. 1–3 and 10–15, a rail anchor spreader assembly is illustrated. The illustrated example of a vehicle 20 includes the rail anchor spreader assembly 76 on its front end, although other locations are permissible. The anchor spreader assembly includes four interconnected plates 78, with each plate having a pair of opposing jaws 80 depending from its lower surface 82. The plates 78 are pivotally secured to the lever arm 84 at pivot 104. The lever arm 84 is pivotally secured to the vehicle chassis 22 at its central fulcrum 86, and pivotally secured to a raise/lower cylinder 88 at its opposite end. Spreader hydraulic cylinders 90 are pivotally secured at each end between the top portion 92 of the plate 78 and the chassis 22. The plates 78 are interconnected by cross member 94 so that they move in unison.

Figure 9:
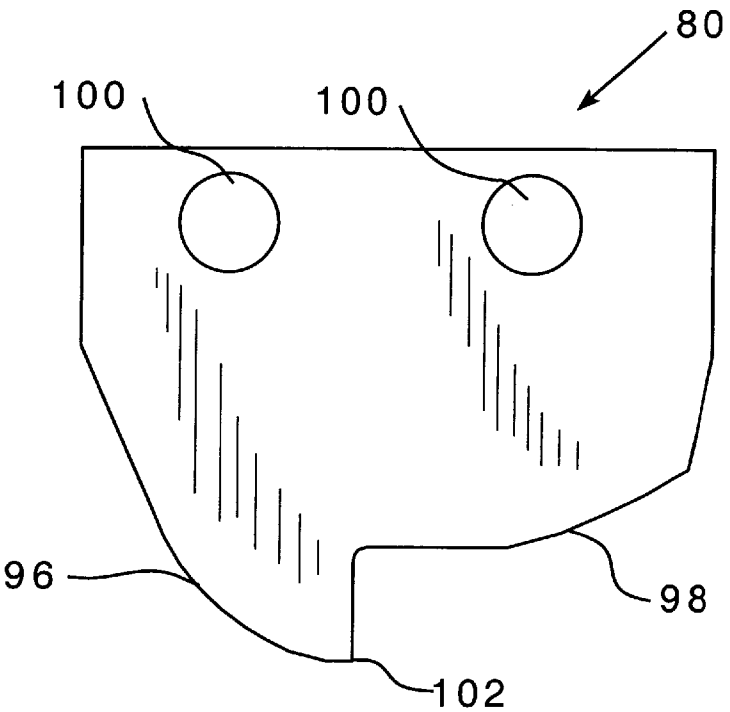
FIG. 9 is a side view of a jaw for a railway anchor spreader according to the present invention.
Figure 8:
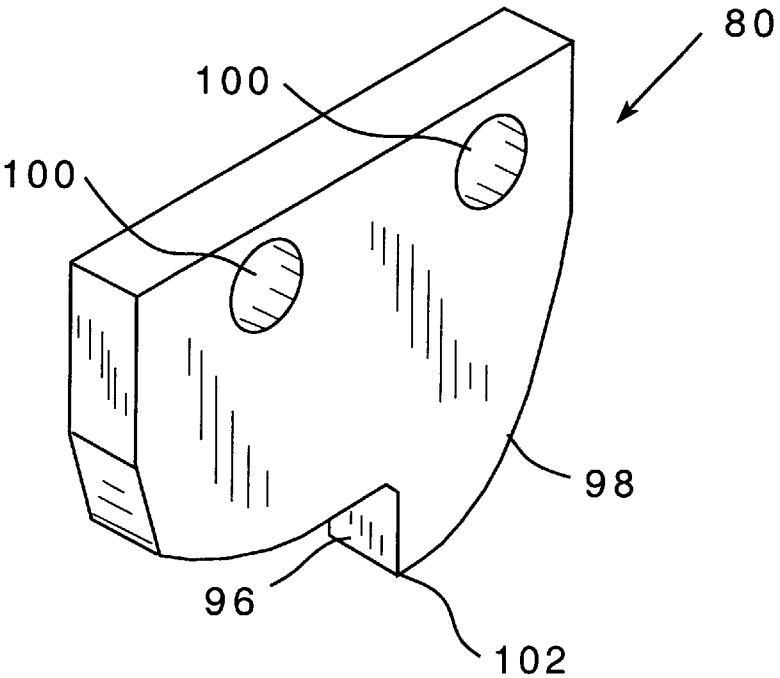
FIG. 8 is an isometric view of a jaw for a railway anchor spreader according to the present invention.
Figures 10, 11, 12, 13, 14, 15:
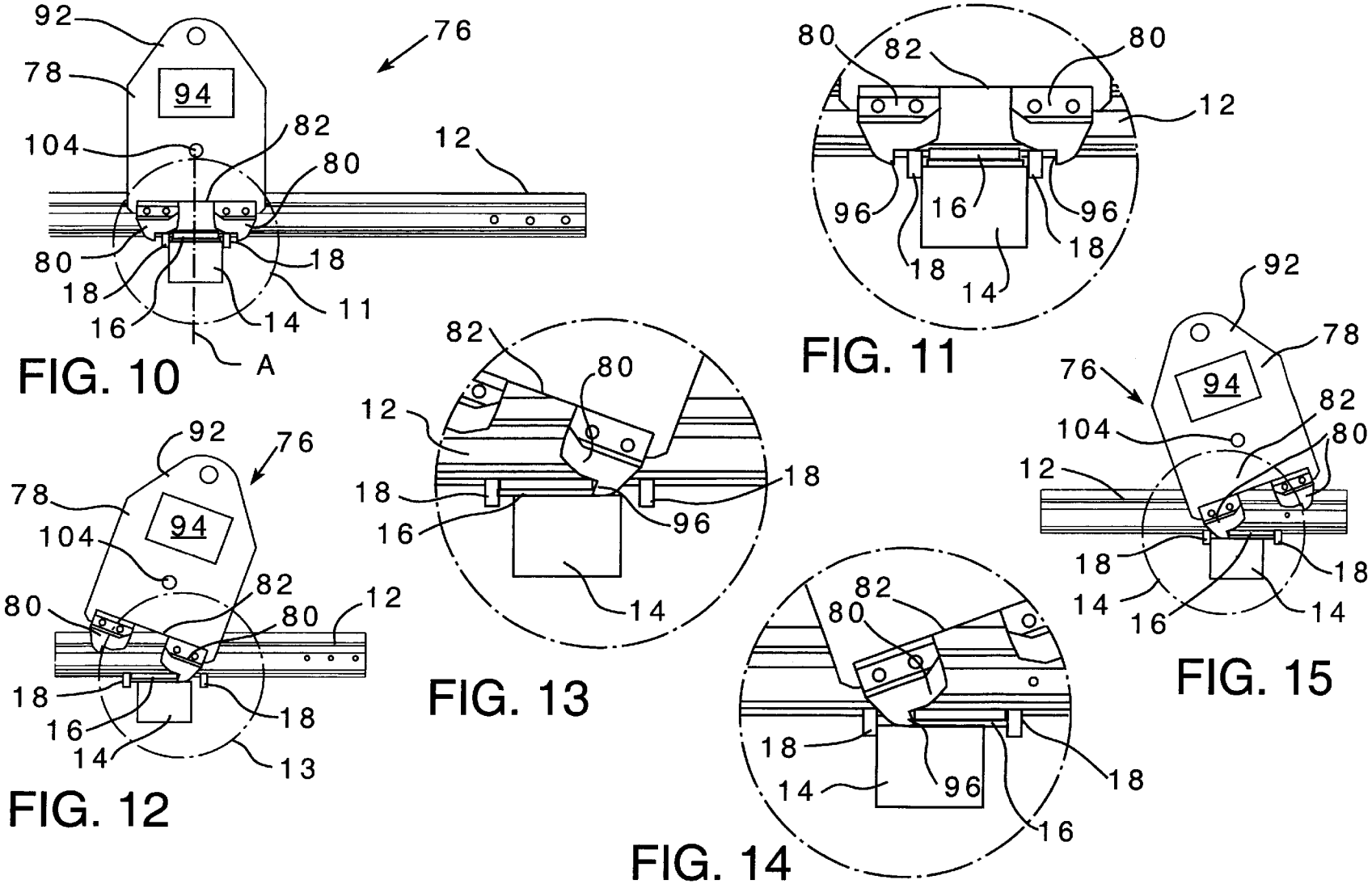
FIG. 10 is a side view of a railway anchor spreader according to the present invention, illustrating the anchor spreader in position to begin an anchor spreading operation.
FIG. 11 is a side view of the detail of circle 11 within FIG. 10.
FIG. 12 is a side view of a railway anchor spreader according to the present invention, illustrating rotation of the anchor spreader in a first direction, to move the first of two anchors away from their associated tie.
FIG. 13 is a side view of the circle 13 within FIG. 12.
FIG. 14 is a side view of the circle 14 within FIG. 15.
FIG. 15 is a side view of a railway anchor spreader, illustrating the anchor spreader being rotated in a second direction, thereby moving the second of two anchor spreaders away from its associated tie.

Referring to FIGS. 8–9, the jaws 80 are illustrated in detail. Each of the jaws 80 defines a tie plate engaging surface 96, and an outside surface 98. The top of each jaw 80 includes mounting holes 100, for securing the jaws 80 to the plates 78. Alternative means of securing the jaws 80 to the plates 78, for example, welding or unitary construction, may of course also be utilized. The jaws 80 will be secured to the plates 78 so that the tie plate engaging surfaces 96 of the opposing jaws 80 face each other, and the outside surfaces 98 face outward. The tie plate engaging surfaces 96 are dimensioned and configured to push a tie plate 16, for example, the tie plate engaging surfaces 96 may be substantially vertical when the plates 78 are in their vertical position. Specifically, the tie plate engaging surfaces 96 are substantially parallel to the arc radius A in FIG. 10, passing substantially halfway in between the surfaces 96. The corner 102, defined between the surfaces 96 and 98, is preferably the farthest point from the pivot 104 between the plates 78 and lever arms 84, and the outside surface 98 may in some examples be in the form of a convex curve.

When the vehicle 20 is moving, the raised/lower cylinder 88 will be extended to push downward on the arm 84, thereby pushing the anchor spreader assembly 76 to an upward position wherein it will not interfere with travel of the vehicle. The raise/lower cylinder 58 of the rail clamp 48 is also extended, raising the rail clamp 48 to its travel position.

Upon reaching a tie 14 that must be replaced, the raise/lower cylinder 58 is retracted to lower the rail clamp 48 until the stop 65 contacts the rail's ball 68. At this point, the clamping hydraulic cylinder 70 is extended, to clamp the grasping tips 64 around the ball 68. The rail clamp 48 has now secured the vehicle 20 against lateral movement.

The raise/lower cylinder 88 will then be retracted to lower the anchor spreader assembly 78 over the tie 14 to be replaced. The anchor spreader 76 may be lowered until the corners 102 of the jaws 80 strike the ballast surrounding the tie 14. At this point, spikes would already have been removed from the tie 14, permitting the tie plate 16 to move. The hydraulic cylinder 90 is first either extended or retracted, thereby rotating the plates 78 in a first direction. In the illustrated example, the cylinder 90 is first retracted to rotate the plate 78 clockwise from the position of FIGS. 10 and 11 to the position in FIGS. 12 and 13, thereby pushing the tie plate 16 into one of the two anchors 18 surrounding the tie 14, moving the anchor 18 away from the tie 14. Next, the cylinder 90 is extended or retracted to rotate the plates 78 in the opposite direction, to move the opposite anchor 18. In the illustrated example, the cylinder 90 is extended to rotate the plate 78 from the position of FIGS. 12 and 13 to the position of FIGS. 14 and 15, thereby pushing the tie plate 16 in the opposite direction, pushing the other anchor 18 away from the tie 14. The cylinder 90 is then used to return the plates 78 to their vertical position of FIG. 10 and the raised/lower cylinder 88 is extended to raise the anchor spreader assembly 76.

The clamping cylinder may then be retracted to release the rail 12 from the grasping tip 64, and the raise/lower cylinder 58 extended to raise the rail clamp 48 to its travel position. The vehicle 20 may now move to the next tie to be replaced.

Referring back to FIGS. 11, 13, and 14, by making the corner 102 the furthest point on the jaw 80 from the pivot 104, rotation of the plate 78 after the spreader assembly 76 has been lowered until the jaws 80 contact the ballast, and then rotating the plates 78, ensures that the jaws 80 will strike the tie plate 16 only, and will not strike the tie 14. By preventing damage to the tie 14 in this manner, the tie 14 may be recycled for other uses after it is removed from use as a railroad tie.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A rail anchor spreader for a railway, the airway having a pair of rails supported on ties, and held in place on said ties by a tie plate between the rail and the tie, and by a pair of rail anchors, each of said rail anchors securing one rail at one side of one tie, said rail anchor spreader comprising:

four plates, each of said plates having a pivot, a top portion, and a bottom edge with a pair of jaws, each of said jaws having a first surface facing the other of said jaws, a second surface facing away from the other of said jaws, and a corner between said first and second surfaces, each of said first surfaces being substantially parallel to an arc radius passing between said pivot and approximately halfway between said jaws, said corner defining a point on each of said jaws farthest from said pivot; and means for simultaneously and reciprocally rotating said plates secured to said top portion.

2. The rail anchor spreader according to claim 1, wherein each of said second surfaces defines a convex curved surface.

3. The rail anchor spreader according to claim 1, wherein said means for simultaneously and reciprocally rotating said plates comprise at least one hydraulic cylinder.

4. The rail anchor spreader according to claim 1, further comprising means for raising and for lowering said rail anchor spreader.

5. The rail anchor spreader according to claim 4, wherein said means for raising and for lowering said rail anchor spreader comprise:

a lever arm having a first end, a second end, and a fulcrum therebetween, said first end being connected to said rail anchor spreader; and a raise/lower hydraulic cylinder connected to said second end.

6. An anchor spreader vehicle for a railway, the railway having a pair of rails supported on ties, and held in place on said ties by a tie plate between the rail and the tie, and by a pair of rail anchors, each of said rail anchors securing one rail at one side of one tie, the rail further having a ball with a pair of lower corners, said anchor spreader vehicle comprising:

a rail clamp, comprising:

a pair of arms, each of said arms terminating in a tip, said tips being dimensioned and configured to engage a lower corner of the ball of the rail;

an anchor spreader, comprising:

four plates, each of said plates being pivotally mounted on said vehicle, a top portion, and a bottom edge with a pair of jaws, each of said jaws having a first surface facing the other of said jaws, a second surface facing away from the other of said jaws, and a corner between said first and second surfaces, each of said first surfaces being substantially parallel to an arc radius passing between said pivot and approximately halfway between said jaws, said corner defining a point on each of said jaws furthest from said pivot; and means for simultaneously and reciprocally rotating said plates secured between said top portion and said vehicle.

7. The vehicle according to claim 6, wherein each of said second surfaces defines a convex curved surface.

8. The vehicle according to claim 6, wherein said means for simultaneously and reciprocally rotating said plates comprise at least one hydraulic cylinder.

9. The vehicle according to claim 6, further comprising means for raising and for lowering said anchor spreader.

10. The rail anchor spreader according to claim 9, wherein said means for raising and for lowering said rail anchor spreader comprise:

a lever arm having a first end, a second end, and a fulcrum therebetween, said first end being connected to said rail anchor spreader; and a raise/lower hydraulic cylinder connected to said second end.

11. The vehicle according to claim 6, further comprising a rail clamp having a pair of arms, each of said arms terminating in a tip, said tips being dimensioned and configured to engage a lower corner of the ball of the rail.

12. The vehicle according to claim 11, wherein said tips are dimensioned and configured to grasp the lower corner of the ball of the rail, directly above a pair of joint bars.

13. The vehicle according to claim 11, wherein said tips define a tip surface, said tip surface facing upward at an angle.

14. A method of spreading rail anchors within a railway, the railway having a pair of rails supported on ties, and held in place on said ties by a tie plate between the rail and the tie, and by a pair of rail anchors, each of said rail anchors securing one rail at one side of one tie, said ties being surrounded by ballast, said rail anchor spreader comprising:

providing an anchor spreader, having four plates, each of said plates having a pivot, a top portion, and a bottom edge with a pair of jaws, each of said jaws having a first surface facing the other of said jaws, a second surface facing away from the other of said jaws, and a corner between said first and second surfaces, each of said first surfaces being substantially parallel to an arc radius passing between said pivot and approximately halfway between said jaws, said corner defining a point on each of said jaws furthest from said pivot;

positioning said anchor spreader above a tie;

lowering said anchor spreader until said jaws contact said ballast;

rotating said four plates in a first direction, striking the tie plates with said jaws, pushing the tie plates into one of the two anchors adjacent to each tie plate; and rotating said four plates in a second direction, striking the tie plates with said jaws, pushing the tie plate into the other of the two anchors adjacent to each tie plate.

15. A jaw for use with a rail anchor spreader for a railway, the railway having a pair of rails supported on ties, and held in place on said ties by a tie plate between the rail and the tie, and by a pair of rail anchors, each of said rail anchors securing one rail at one side of one tie, the rail anchor spreader having four rotatably mounted plates, each plate having a bottom jaw-attachment portion and a pivot, said jaw comprising:

top having means for mounting said jaw on a bottom jaw attachment portion of one of the plates;

a first, substantially vertical, surface, dimensioned and configured to strike a rail anchor;

a second surface opposite said first surface;

a corner between said first and second surfaces, jaws, said corner defining a point on said jaws farthest from said pivot; and the jaw being structured to strike a tie plate without striking a tie upon pivoting of the plate.

16. The jaw according to claim 15, wherein said second surface defines a convex curved surface.

17. The jaw according to claim 15, wherein said means for mounting said jaw on a bottom jaw attachment portion of one of the plates includes at least one aperture dimensioned and configured to receive a bolt.

* * * * *

UNITED STATES PATENT AND TRADEMARK OFFICE

CERTIFICATE OF CORRECTION

PATENT NO. : 6,662,729 B1
DATED : December 16, 2003
INVENTOR(S) : Harry Madison

It is certified that error appears in the above-identified patent and that said Letters Patent is hereby corrected as shown below:

Column 7,
Line 5, “airway” should read -- railway --.

Column 8,
Line 58, insert -- a -- prior to “top”.

Signed and Sealed this

Thirtieth Day of March, 2004

JON W. DUDAS
*Acting Director of the United States Patent and Trademark Office*